United States Patent [19]

Imaizumi

[11] Patent Number: 4,902,357

[45] Date of Patent: Feb. 20, 1990

[54] METHOD OF MANUFACTURE OF PERMANENT MAGNETS

[75] Inventor: Nobuo Imaizumi, Hino, Japan

[73] Assignee: Namiki Precision Jewel Co., Ltd., Tokyo, Japan

[21] Appl. No.: 188,393

[22] PCT Filed: Jun. 27, 1987

[86] PCT No.: PCT/JP86/00327

§ 371 Date: Apr. 26, 1988

§ 102(e) Date: Apr. 26, 1988

[87] PCT Pub. No.: WO88/00387

PCT Pub. Date: Jan. 14, 1988

[51] Int. Cl.[4] ..... H01F 1/02

[52] U.S. Cl. ..... 148/101; 148/102; 148/103; 148/104; 419/12; 419/13; 419/19; 419/20; 419/28; 419/29; 419/55; 419/57

[58] Field of Search ..... 148/101, 102, 103, 104, 148/105; 419/12, 13, 19, 20, 28, 29, 55, 57

[56] References Cited

U.S. PATENT DOCUMENTS 4,597,938 7/1986 Matsuura et al. ..... 419/23
4,601,875 7/1986 Yamamoto et al. ..... 419/23

FOREIGN PATENT DOCUMENTS 62-112702 5/1987 Japan .

*Primary Examiner*—John P. Sheehan
*Attorney, Agent, or Firm*—Sixbey, Friedman, Leedom & Ferguson

[57] ABSTRACT

This invention concerns a heat treatment method for rare earth type permanent magnets which are primarily of the Nd-Fe-B type. With regard to these permanent magnets, which oxidize rather easily in the air, the alloy is crushed, and either compression formed in a magnetic a non-magnetic field, sintered at 900° to 1,200° C., and then machined into the shape desired, and then solution treated in an atmosphere of oxygen and/or nitrogen at a temperature of 900° to 1,200° C., and then aged at 300° to 900° C. in order that an oxide and/or nitride protective layer of 0.001 to 10 μ be formed on the surface of the permanent magnet to prevent corrosion and in order to relieve machining strain.

21 Claims, 2 Drawing Sheets

METHOD OF MANUFACTURE OF PERMANENT MAGNETS

Figure 1:
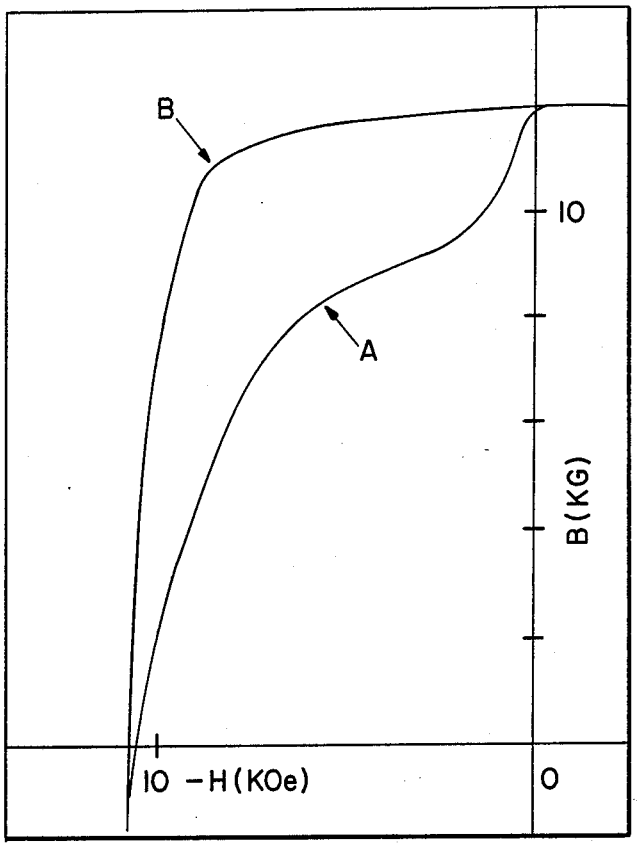

This invention concerns a heat treatment method for rare earth type permanent magnets, principally those of the Nd-Fe-B variety.

BACKGROUND OF THE TECHNOLOGY

Since the discovery that there would be theoretically very high magnetic properties [(BH) max~50 MGOe] when rare earth metals and transition metals are combined into metal compounds in a ratio of 2:17 to form a rare earth-transition metal alloy, there have been a number of attempts to obtain practical permanent magnet applications using these types of compounds. One example is the Sm-Co-Cu-Fe metal compound where (BH)max has reached ~30 MGOe. Further, with Nd-Fe metal compounds, high magnetic properties of (BH)max~40 MGOe have been reached. These alloy formulations are crushed into powder, and then aligned and compression formed in a magnetic field, or formed in a non-magnetic field, sintered, solution-treated, and aged to form a mass, and then cut and polished into permanent magnets of the shape required according to the most usual methods of their preparation. Since the rare earth and ferrous type permanent magnets, particularly the R-Fe-M permanent magnets (where R represents one or more types of rare earth metals, and M represents B or other metalloid element), are easily oxidized when exposed to air, when they are used in precision applications, such as in miniature electronic parts for magnetic circuits using permanent magnets, there are many instances were oxidation caused by exposure of the magnet to air leads to a degradation of the magnetic properties and fluctuations in their permanence due to changes in the magnetic space. Because of this, the prior art has used Cr or Ni plating to cover the surface to prevent this oxidation.

When wet type plating means are used, however, the surface of the permanent magnet itself can be corroded by the degreasing and oxidation removal processes, which makes plating difficult. In addition, following the plating operation, gaps sometimes exist between the permanent magnet surface and the plating. Peeling of the plating is likely in these areas. Also, pinhole defects are common. Overall magnetic properties are additionally likely to be affected by the numerous processing steps involved, sintering, solution treating, aging, machining (cutting grinding and polishing) to obtain the desired magnetic properties and shape, etc., which are apt to lead to surface defects. FIG. 1A shows a graph of the resulting demagnetization curve where the effects above types of defects can be seen. These phenomena are especially dramatic in permanent magnets which have a relatively small volume but a relatively large surface area. Such defects result in lower producton yields.

DISCLOSURE OF THE INVENTION

This invention concerns a permanent magnet alloy conforming to the general formula: R(T, M)z (where R represents one or a mixture of two or more rare earth metals, T is transition metals such as Fe or Co, M is a metalloid element such as B, and z is 4 to 9) where the alloy is crushed and compressed in a magnetic or, a non-magnetic field to form the green body. Then first, for permanent magnets having a small surface area/-volume ratio, they are sintered at a temperature of 900° to 1200° C., then machined into appropriate shapes, and then solution treated at 900° to 1200° C. in a $10^{-8}$ to 1 Torr gas atmosphere, after which they are aged at 300° to 900° C. Secondly, for permanent magnets having a large surface area volume ratio, they are sintered at 900° to 1200° C., solution treated at 900° to 1200° C., machined into appropriate shapes, and then aged in a gas atmosphere of $10^{-8}$ Torr at 300° to 900° C. Thirdly, they can be sintered at 1000° to 1200° C., machined into usable shapes, re-sintered in a $10^{-8}$ to 1 Torr gas atmosphere at 1000° to 1200° C., in order to manufacture these permanent magnets. The gas environment used for these various processes may be oxygen, nitrogen or a mixture; it is desirable that the surface layer be 10μ or less in thickness. When heating, if the amount of oxygen and/or nitrogen in the atmosphere is less than $10^{-8}$ Torr, then a surface layer will not be formed, or, if there is more than 1 Torr, then the oxide and/or the nitride layer will become skin-like and cause degradation of the magnetic properties of the permanent magnets themselves. Also, if heated to a temperature of under 300° C., formation of the surface layer will not take place. If a temperature of 1200° C. is exceeded, then oxygen and/or nitrogen will disperse into the interior of the permanent magnet and magnetic properties will be drastically reduced. Accordingly, under these conditions, it is not desirable for a surface layer thickness of 10μ to be exceeded. The reason for the limitations placed on the temperature is to eliminate strain layers from machining in the final product and to promote the maintenance of magnetic force. In other words, with the sintering, solution treating and aging processes, the appropriate temperature ranges are: 900° to 1200° C., 900° to 1200° C. and 300° to 900° C., respectively. If any of those ranges are not observed, the result will be a degradation of magnetic properties, or strain layers resulting from machining which adversely affect the magnets.

In this invention, the oxygen causes the formation of a black-colored rust layer on the surface of the permanent magnet which prevents oxidation and allows it to be stable in the air. When nitrogen is used, a similar effect is observed, and one of the objectives of this invention, preventing rust, is thereby realized.

At the same time, by accomplishing the heat treatment according to this invention, following any machining procedures after the sintering has taken place, any machining strain that was induced can be eliminated during the aging process.

A SIMPLE EXPLANATION OF THE FIGURES

FIG. 1 shows a demagnetization curve for permanent magnets.

A: for the production method of the prior art involving sintering, solution treating, aging, and machining for the permanent magnets.

B: for the method of this invention where there is sintering, machining, solution treating, and aging for the permanent magnets.

Figure 2:
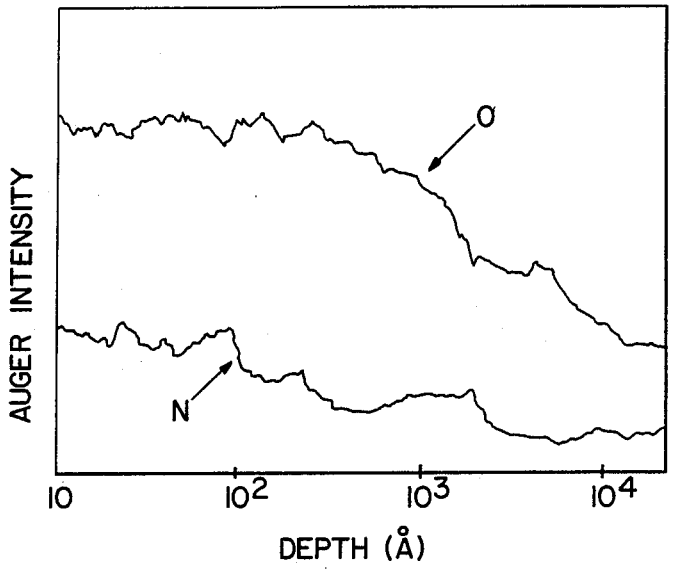

FIG. 2 shows an Auger spectral analysis of a magnet prepared according to this invention. It indicates the concentration distribution in the direction of the layer thickness.

THE BEST MEANS OF IMPLEMENTING THE INVENTION

Below, examples of some of the best means of implementing this invention will be described.

EXAMPLE 1

A formulation of $Nd(Fe_{0.9}B_{0.1})_5$ alloy was placed in solution, roughly crushed, and finely crushed to prepare the green body for the magnet. It was sintered at a temperature of 1080° C. to obtain a 9 mm square sintered block. Next this sintered block was machined to dimensions of 8 mm square, after which it was solution treated in a $10^{-6}$ Torr oxygen partial pressure atmosphere at 1050° C. for 30 min, and then it was cooled to room temperature. Next, it was aged for 60 minutes at 600° C.; this was called sample A. On the other hand, the same type of sintered block was aged prior to machining it. This, Sample B, was the machined to an 8 mm block. Table 1 shows the physical properties of Samples A and B.

TABLE 1

| | A | B |
|---|---|---|
| Br (KG) | 11.6 | 11.6 |
| IHc (KOe) | 10.5 | 10.4 |
| (BH max (MG.Oe) | 31.7 | 30.5 |

Samples A and B were left in a 95% humidity, 65° C. environment and were checked for corrosion. On the processed surfaces of sample B, a red-colored rust appeared, but only a small amount of red-colored rust was observed around the perimeter edges of sample A; there was no change at all to the surface areas.

EXAMPLE 2

An Nd-Fe-B alloy was melted and cast into an ingot. A vibrating mill was then used to crush it into 5 to 20μ powder. This was then compressed in a magnetic field and then formed into blocks which were sintered for an hour in a vacuum at 1120° C. The resulting blocks were divided into samples A and B. The A sample was then processed according to methods of the prior art: solution treatment for 1 hour at 1100° C. followed by aging for an hour at 600° C. and machining to the proper dimensions to form the permanent magnet.

Sample B was then processed according to this invention. It was machined to the same dimensions and shape, and then solution treated at 1100° C. for 1 hour, and then aged at 600° C. for an additional hour.

The demagnetization curves of the respective magnets were measured. As shown in FIG. 1, Sample A had a wavy curve, while B showed a good curve with a sharp shoulder.

EXAMPLE 3

$Nd_{0.8}Pr_{0.1}La_{0.05}Dy_{0.05}(Fe_{0.92}B_{0.08})_6$ alloy was used to make the green body as in Example 1. Sintering then took place at temperatures of 1050°, 1100° and 1200° C. respectively to obtain sintered blocks 9 mm square. These machined to 8 mm square blocks, and then they were solution treated in an atmosphere mixed oxygen and nitrogen in a 1:4 ratio at $10^{-3}$ Torr for 30 minutes at temperatures of 1050°, 1000°, and 900° C., respectively. Then, they were aged in this same atmosphere for 60 minutes at 600° C. to prepare samples (Samples No. 1 through 9). Then these, along with samples made according to the prior art method (Samples 10 through 12) were measured for their magnetic properties [maximum energy product: $BH_{max}$(MGOe)] after having been left to stand at 60° C. in 90% humidity for 100 hours. Table 2 shows the results.

TABLE 2

| No. | Heat treatment (°C.), machining process order | BH* |
|---|---|---|
| 1 | 1,050 → machining → 1,050 → 600 | 33.5** |
| 2 | 1,050 → machining → 1,000 → 600 | 34.0** |
| 3 | 1,050 → machining → 900 → 600 | 33.0** |
| 4 | 1,100 → machining → 1,050 → 600 | 34.5** |
| 5 | 1,100 → machining → 1,100 → 600 | 34.0** |
| 6 | 1,100 → machining → 900 → 600 | 34.2** |
| 7 | 1,150 → machining → 1,050 → 600 | 35.0** |
| 8 | 1,150 → machining → 1,000 → 600 | 35.2** |
| 9 | 1,150 → machining → 900 → 600 | 34.0** |
| 10 | 1,100 → 1,050 → 600 → machining | 32.0 X |
| 11 | 1,100 → 1,000 → 600 → machining | 31.5 X |
| 12 | 1,100 → 900 → 600 → machining | 31.7 X |

** = No change
X = Rust all over the surface

EXAMPLE 4

Sintered blocks were prepared as in Example 3, and after solution treating, the samples were machined into 8 mm blocks prior to aging them. The magnetic properties were measured for these samples [maximum energy product: $BH_{max}$ (MGOe)] before and after leaving in a 60° C. 90% humidity environment for 100 hours. The appearance of any rust was also observed. Those results appear in Table 3.

TABLE 3

| No. | Heat treatment (°C.), machining process order | BH* |
|---|---|---|
| 13 | 1,050 → 1,050 → machining → 600 | 35.0** |
| 14 | 1,050 → 1,000 → machining → 600 | 34.8* |
| 15 | 1,050 → 900 → machining → 600 | 33.2* |
| 16 | 1,100 → 1,050 → machining → 600 | 35.0** |
| 17 | 1,100 → 1,000 → machining → 600 | 35.0** |
| 18 | 1,100 → 900 → machining → 600 | 32.8* |
| 19 | 1,150 → 1,050 → machining → 600 | 34.8** |
| 20 | 1,150 → 1,000 → machining → 600 | 34.5** |
| 21 | 1,150 → 900 → machining → 600 | 33.6* |

**No change
*Non-continuous rust on edges

EXAMPLE 5

An alloy composed of $Nd_{0.9}Dy_{0.1}(Fe_{0.8-1}Co_{0.1}B_{0.09})_{5.8}$ was sintered as in Example 1 and machined into 8 mm square blocks. Next, the blocks were solution treated in a mixed gas atmosphere of oxygen:nitrogen 1:4 under various partial pressures, and then they were aged. These samples were then tested for magnetic properties [maximum energy product: $BH_{max}$(MGOe)] and the appearance of rust after letting them stand at 60° C. and 90% humidity for 100 hours. The results appear in Table 4.

| No. | Mixed Gas Partial Pressure (Torr) | BH | * |
|---|---|---|---|
| 22 | $5 \times 10^{-8}$ | 38.5 | # |
| 23 | $2 \times 10^{-6}$ | 38.6 | O |
| 24 | $5 \times 10^{-3}$ | 38.3 | * |
| 25 | $1 \times 10^{-1}$ | 35.2 | * |
| 26 | 1 | 30.4 | # |

*No change
O: Non-continuous rust on edges
#: Continuous rust on edges

As is clear from Table 4, when the gas partial pressure is low, there is an undesirable weakness in the rust protective layer on the surface. Also, if the gas pressure is too high, oxygen and nitrogen permeate to the inside of the magnet, not just the surface, causing the original magnetic properties to decline.

EXAMPLE 6

A alloy formulation of $Nd_{0.0}Dy_{0.1}(Fe_{0.92}B_{0.08})_{5.8}$ was sintered, machined, solution treated and aged as in Example 1. Auger spectrography was used to assess the surface condition. FIG. 2 shows the concentration distribution of $O_2$ and $N_2$ in the thickness direction of the surface layer. As can be seen from FIG. 2. Nitrogen and oxygen are captured to a depth of $10^3$ to $10^4$ Å from the surface of the magnets. When these samples were left to stand for 100 hours at 60° C. and 90% humidity, almost no rust was noted.

As described above, by using the surface treatment method of this invention in permanent magnets, superior corrosion protection is realized and there is a strong bond between the protective layer and the magnet. Also, since it is very easy to control the coating layer, this method is appropriate for precision parts applications in miniature electronic circuits. This method provides both mechanical and cost advantages over those methods used in the prior art, and the aging process in this invention also works to relieve any machining strain in the surface layer from machining etc., so that magnetic retention is improved and machining strain is eliminated through the heating in the aging process. This helps damaged surface layers to return to their normal structure.

I claim:

1. A method for the manufacture of a permanent magnet from a permanent magnet alloy powder having the composition $R(T,M)_z$, wherein R is at least one rare earth element selected from the group consisting of Nd, Pr, La and Dy; T is a transition metal selected from the group consisting of Fe and a mixture of Fe and Co; M is boron; and z=4 to 9, including the steps of:
   (a) pressure forming said powder to form a green body;
   (b) sintering said green body at a temperature in the range 900° to 1200° C.;
   (c) machining the sintered green body into a utilizable shape;
   (d) solution treating the machined body formed in step (c) at a temperature in the range of 900° to 1200° C. in an atmosphere of a gas selected from the group consisting of nitrogen, oxygen and mixtures of nitrogen and oxygen at a pressure in the range of $10^{-8}$ to 1.0 Torr; and
   (e) aging the solution treated machined body formed in step (d) at a temperature in the range of 300° to 900° C. to form a corrosion resistant permanent magnet.

2. The method of manufacturing a permanent magnet described in claim 1, wherein step (a) is carried out in a magnetic field.

3. The method of manufacturing a permanent magnet described in claim 1, wherein step (a) is carried out in a nonmagnetic field.

4. The method of manufacturing a permanent magnet described in claim 1, wherein said gas is nitrogen.

5. The method of manufacture a permanent magnet described in claim 1, wherein said gas is oxygen.

6. The method of manufacturing a permanent magnet described in claim 1, wherein said gas is a mixture of nitrogen and oxygen.

7. The method of manufacturing a permanent magnet described in claim 1, wherein step (d) of said method produces a layer having a thickness of 0.001 to 10 microns on the surface of said magnet, said layer having a composition selected from the group of oxides and nitrides.

8. A method for the manufacture of a permanent magnet from a permanent magnet alloy powder having the composition $R(T, M)_z$, wherein R is at least one rare earth element selected from the group consisting of Nd, Pr, La and Dy; T is a transition metal selected from the group consisting of Fe and a mixture of Fe and Co; M is boron; and z=4 to 9, including the steps of:
   (a) pressure forming said powder to form a green body;
   (b) sintering said green body at a temperature in the range of 900° to 1200° C.;
   (c) solution treating the sintered green body formed in step (b) at a temperature in the range of 900° to 1200° C.;
   (d) machining the solution treated body formed in step (c) into a utilizable shape; and
   (e) aging the solution treated machined body formed in step (d) at a temperature in the range of 300° to 900° C. in an atmosphere of a gas selected from the group consisting of nitrogen, oxygen and mixtures of nitrogen and oxygen at a pressure in the range of $10^{-8}$ to 1.0 Torr to form a permanent magnet.

9. The method of manufacturing a permanent magnet described in claim 8, wherein step (a) is carried out in a magnetic field.

10. The method of manufacturing a permanent magnet described in claim 8, wherein step (a) is carried out in a nonmagnetic field.

11. The method of manufacturing a permanent magnet described in claim 8, wherein said gas is nitrogen.

12. The method of manufacture a permanent magnet described in claim 8, wherein said gas is oxygen.

13. The method of manufacturing a permanent magnet described in claim 8, wherein said gas is a mixture of nitrogen and oxygen.

14. The method of manufacturing a permanent magnet described in claim 8, wherein step (e) of said method produces a layer having a thickness of 0.001 to 10 microns on the surface of said magnet, said layer having a composition selected from the group of oxides and nitrides.

15. A method for the manufacture of a permanent magnet from a permanent magnet alloy powder having the composition $R(T, M)_z$, wherein R is at least one rare earth element selected from the group consisting of Nd, Pr, La and Dy; T is a transition metal selected from the group consisting of Fe and a mixture of Fe and Co; M is boron; and z=4 to 9, including the steps of:
   (a) pressure forming said powder to form a green body;
   (b) sintering said green body at a temperature in the range 900° to 1200° C.;
   (c) machining the sintered green body into a utilizable shape; and
   (d) re-sintering said machined sintered green body at a temperature in the range of 900° to 1200° C. in an atmosphere of a gas selected from the group consisting of nitrogen, oxygen and mixtures of nitrogen and oxygen at a pressure in the range of $10^{-8}$ to 1.0 Torr to form a permanent magnet.

16. The method of manufacturing a permanent magnet described in claim 15, wherein step (a) is carried out in a magnetic field.

17. The method of manufacturing a permanent magnet described in claim 15, wherein step (a) is carried out in a nonmagnetic field.

18. The method of manufacturing a permanent magnet described in claim 15, wherein said gas is nitrogen.

19. The method of manufacture a permanent magnet described in claim 15, wherein said gas is oxygen.

20. The method of manufacturing a permanent magnet described in claim 15, wherein said gas is a mixture of nitrogen and oxygen.

21. The method of manufacturing a permanent magnet described in claim 15, wherein step (d) of said method produces a layer having a thickness of 0.001 to 10 microns on the surface of said magnet, said layer having a composition selected from the group of oxides and nitrides.

* * * * *